United States Patent [19]

Houseman et al.

[11] Patent Number: 4,570,943

[45] Date of Patent: Feb. 18, 1986

[54] SEALING FLASHING FOR BUILDINGS WITH INTERLOCKING RING MEMBERS

[75] Inventors: David G. Houseman, Richmond; Gary J. Binding, Boronia, both of Australia

[73] Assignee: John Deks Australia Pty. Ltd, Bayswater, Australia

[21] Appl. No.: 706,329

[22] Filed: Feb. 27, 1985

[30] Foreign Application Priority Data

Feb. 29, 1984 [AU] Australia ..... PG3848

[51] Int. Cl.[4] ..... F16J 15/02; F16L 41/06; E04D 13/14

[52] U.S. Cl. ..... 277/12; 277/212 FB; 52/60; 285/43

[58] Field of Search ..... 277/1, 9, 12, 32, 212 FB; 52/60; 285/3, 4, 42–44

[56] References Cited

U.S. PATENT DOCUMENTS

| | | | |
|---|---|---|---|
| 1,282,535 | 10/1918 | Bropson | 285/44 |
| 3,602,530 | 8/1971 | Elwart | 285/4 |
| 3,977,137 | 8/1976 | Patry | 52/60 |
| 4,160,347 | 7/1979 | Logsdon | 277/12 X |
| 4,211,423 | 7/1980 | Resech | 277/12 X |
| 4,333,660 | 6/1982 | Cupit | 52/60 X |

FOREIGN PATENT DOCUMENTS

| | | | |
|---|---|---|---|
| 12186/28 | of 1928 | Australia | 285/43 |
| 1233102 | 5/1960 | France | 277/212 FB |

*Primary Examiner*—Robert S. Ward
*Attorney, Agent, or Firm*—Bucknam and Archer

[57] ABSTRACT

A flashing device for use on a building roof to seal about a pipe passing therethrough, comprising a sleeve of rubber or the like through which the pipe may pass with the upper end of the sleeve in sealing contact with the periphery of the pipe. A pair of rigid ring members are provided at the lower end of the sleeve, with a portion of the sleeve located between the ring members. The ring members being adapted to interlock together to compress the portion of the sleeve therebetween into sealing relation with a sheet material also located between the ring members.

13 Claims, 4 Drawing Figures

SEALING FLASHING FOR BUILDINGS WITH INTERLOCKING RING MEMBERS

This invention relates to flashing devices as used to produce a weather-tight seal between a pipe conduit or other member which extends through the roof or wall of a building or like structure.

In the building industry there have been several constructions available for providing a seal around a pipe or other member extending through a roof or a building, but in the majority of cases these constructions required a considerable amount of fabrication on the site, and individual fitting to suit each installation. These prior constructions are satisfactory when constructed and fitted with the necessary degree of skill, but in recent times, with the general reduction in the availability of skilled labour, and the high costs of same, there is a need for a flashing construction which can be fitted by unskilled persons and which ensures an effective seal is established.

In U.S. Pat. No. 4,333,660 there is proposed a flashing or sealing device having a sleeve of resilient material with an integral outwardly extending flange at one end. An annular member of non-resilient flexible material is bonded to the flange to extend about the sleeve. In use a pipe or other conduit may extend through the sleeve, with the end of the sleeve remote from the flange stretched so as to sealably engage the external surface of the pipe. The flange and annular member bonded thereto are manually worked to closely fit the contour of a roof sheet through which the pipe extends, and is secured thereto by rivets or screws. The flange if resilient material is thus compressed between the roof sheet and the annular member to establish an effective seal with the roof sheet.

This flashing device is particularly suitable for use on metal roofs, where it is convenient to secure the flange by rivets or screws, but presents problems with other roof materials such as slates or tiles. Firstly it is difficult to make an accurately shaped hole for the passage of the pipe through such a roof. In order to deal with this problem the flange of a flashing device as above discussed would have to be large with resultant cost increases and transport and storage disadvantages. Secondly, as the flange is attached by screws and rivits there is the added problem of drilling tiles or slates and the high risk of damage or breakage of the tile or slate.

It is thus the principle object of the present invention to provide an improved flashing device whhich is simple to install, effective in operation, and may be used in sealing about pipes or conduits projecting through tile or slate roofs.

There is accordingly provided by the present invention a device for flashing about a pipe or conduit passing through a roof or wall;

a first member having an aperture therethrough for a pipe or conduit to pass through and a continuous first abutment surface extending about said aperture, a second member having an aperture therethrough for the pipe or conduit to pass through and a continuous second abutment surface extending about said aperture, said apertures and abutment surfaces being arranged so that when the first and second members are assembled to a pipe or conduit that extends through the respective apertures, the first and second abutment surface are in an opposing face to face substantially parallel relation substantially transverse to the axis of the pipe or conduit, means to secure the first and second members together in said assembled relation with a sheet of flexible material therebetween and through which the pipe or conduit also extends and a sleeve of flexible resilient material adapted at one end for attachment to the first member so that a pipe or conduit extending through the first and second members also extends through the sleeve, the other end of the sleeve being adapted to sealably engage the external surface of the pipe or conduit extending therethrough, said one end of the sleeve including a portion located in use to be compressed between the sheet and one of the members when the first and second members are secured together in said assembled relation.

Preferably the sleeve is provided with a bead portion that is received in a bead groove provided in the first member. Alternatively the perimetal edge of the first member is received in a recess or cavity formed in the internal surface of the bead.

Conveniently the first and second members are provided with inter-lockable elements to engage when the members are assembled, and to maintain the members in pressure engagement with the sheet. The lockable elements preferably engage in a snap action achieved by pressing the members together in a generally axial direction. Alternatively the inter-lockable elements may comprise a series of tongues on one member and slots in the other arranged so that the tongues extend through the slots, on assembly of the members, and the tongues are then deformed, twisted or otherwise manipulated to prevent their withdrawal from the slots.

Preferably the bead is located inwardly of the wall of the sleeve, at the one end thereof, and directed toward the other end of the sleeve. When the sleeve and first member are assembled the sleeve extends about the outer marginal portion of the first member, with the bead seated in a downward directed bead groove formed in the under surface of the first member. Preferably the one end of the sleeve is in a stretched condition to receive the first member and so the first member and the sleeve once assembled will normally remain so.

The bead and the bead groove are dimensions so that when the first and second members are assembled together, with the sheet material therebetween, the bead will be compressed between sheet material and the first member to form a moisture and weather seal. Preferably the first and second members engage opposite sides of the sheet material, and clamp same therebetween when the bead is in the compressed state.

In use the first and second members are assembled to the pipe or conduit on opposite sides of a sheet of flexible material, having an aperture therethrough for the passage of the pipe or conduit.

It is to be understood that the two members may be assembled to the sheet of flexible material prior to inserting the pipe or conduit through the respective apertures in the members, or in-situ on the pipe or conduit. Thus the two members and the sheet may be marketed as a combination either in an assembled or unassembled state.

The first and second members may be adapted to provide a closed cavity therebetween when assembled together, so the cavity may be filled with a flowable sealant compound. An aperture or port may be provided communicating with the cavity so that the sealant may be forced into the cavity direct from a sealant container or pressure sealant applicator.

The sleeve of flexible resilient material preferably tapers over at least part of its length. This form of sleeve may be used to fit a range of sizes of pipes or conduits by cutting the sleeve off at the appropriate location along the length of the tapered portion to provide an opening at the end of the sleeve that will sealably fit the particular size pipe or conduit. Suitable markings, such as annular grooves or ridges, may be provided on the surface of the tapered portion of the sleeve, to indicate the location at which to cut the sleeve for various sizes of pipe or conduit. The use of ridges has the additional advantage that it strengthens the edge of the sleeve against tearing then the sleeve is cut.

The provision of the resilient sleeve as above described enables the same first and second members to be used on a range of sizes of pipes or conduits.

The use of the sleeve of resilient material also has the advantage that misalignment of the pipe or conduit with the apertures in the first and second member may be accommodated by deflection of the sleeve. Due to the flexible resilient nature of the sleeve, any deflection thereof will not adversely affect the seal between the sleeve and the pipe or the first member.

The resilient sleeve may be arranged substantially co-axial with the apertures in the first and second member, or with its axis inclined thereto. As the surface of most roofs are inclined to the axis of any pipe or conduit extending therethrough at an angle that may range from 15° to 45° it may be preferable to have the axis of the sleeve inclined such as at 30°. The flexability of the sleeve will accommodate any difference between the inclination of the roof and the pipe or conduit.

The present invention will be more readily understood from the following description of one practical arrangement of the flashing device as illustrated in the accompanying drawings.

Figure 1:
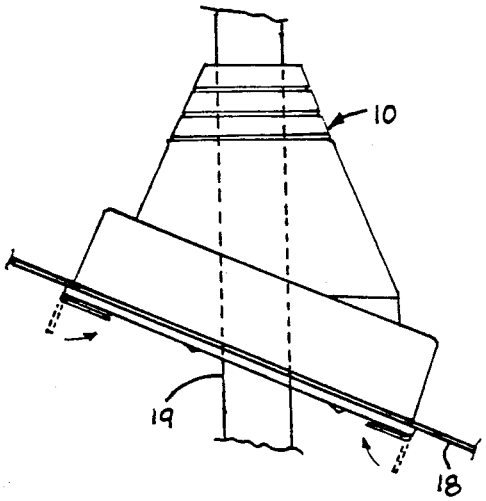
FIG. 1 is an illustrative side view of the flashing device fitted to a pipe extending through a roof.
Figures 2, 3:
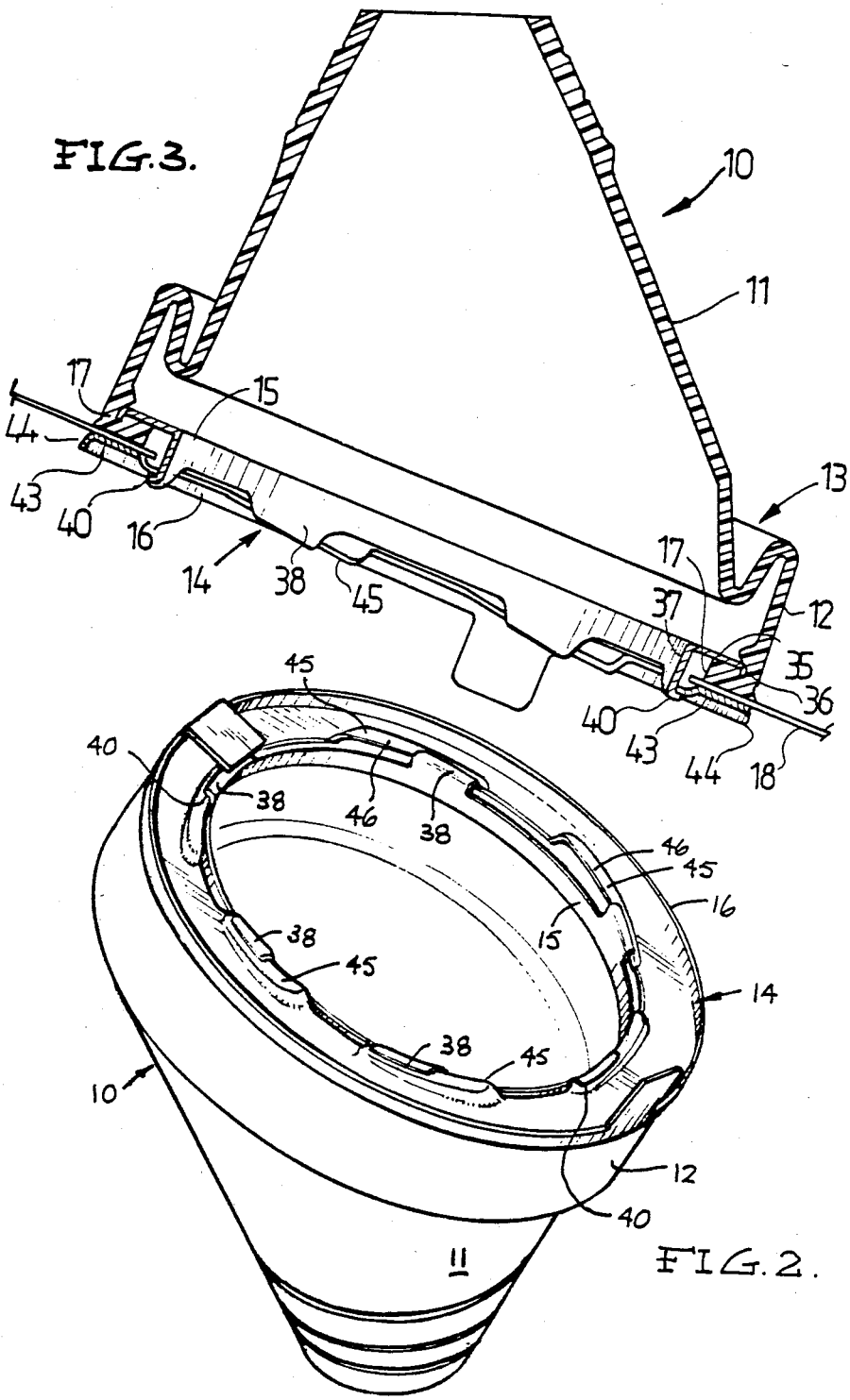
FIG. 2 is a perspective view from the under side of the flashing device.
FIG. 3 is a diametral section view of the flashing device.

Referring now to FIGS. 1, 2 and 3 of the drawings the flashing device comprises a sleeve member 10, made of a suitable flexible resilient material such as a natural or synthetic rubber, having a main tubular section 11 and an apron 12 interconnected by a re-entrant fold portion 13. The attachment ring assembly 14 comprises inner and outer ring members 15 and 16, carrying interlocking components which will be described in greater detail hereinafter. The inner ring member 15 is located substantially within the apron 12 of the sleeve member, with the sealing ring portion 17, integral with the apron, located between the peripheral portions of the inner and outer rings 15 and 16.

In use the sleeve member 10 is secured by the ring assembly 14 to a sheet 18 of flexible non-resilient material, such as light gauge metal, so that a pipe or like conduit 19 may pass through an opening in the sheet 18 and through the sleeve member 10, with the latter providing a seal between the pipe 19 and the sheet 18. The sheet of flexible non-resilient material 18 is fitted to a roof structure in the conventional manner which will be described in further detail hereinafter.

The inner ring member 15 has a generally annular portion 35, having a short axially extending lip 36 on the outer periphery and a longer axially extending flange or skirt 37 on the inner periphery. The lip 36 and skirt 37 provide stiffening to the annular portion 35, so that it will remain substantially flat under the clamping pressures generated by the assembly of the inner and outer ring members 15 and 16 as hereinafter described. The inner flange 37 has spaced around its lower edge a plurality of tongues 38, which terminate in outwardly directed lips 40. Each of the lips are located in a respective plane, with each plane inclined equally to the plane of the annular portion 35 of the inner ring member 15.

The outer ring member 16 is of generally annular shape having a flat portion 43 which, in use, is disposed parallel to the annular portion 35 of the inner ring member 15. The flat portion 43 of the outer ring member 16 has a continuous lip 44 about the outer peripheral edge thereof, and a plurality of ramp elements 45 spaced around the inner peripheral edge. The lip 44 and the ramps 45 provide stiffening to the flat portion 43 of the lower ring member 16 so that it will remain substantially flat when subject to clamping pressures.

The ramps 45 have lower inclined surfaces 46 each located in a respective plane inclined to the plane of the flat portion 43, substantially equal to the inclination of the lips 40 to the plane of the annular portion 35. The portions of the inner periphery of the outer ring member 16, intermediate the ramps 45, are cut out to permit the tongues 38 of the inner ring member 15 to pass through the central opening of the outer ring member 16. The surfaces 46 of the ramps 45 extend radially inward to an extent to underlie the lips 40 on the tongues 45. Thus, in use, the outer ring member 16 may be assembled to the inner ring member 15, whilst the latter is attached to the sleeve member 10, by locating the tongues 45 in general axial alignment with the spacers between the ramps 45, and subsequent rotating the outer ring member 16 relative to the inner ring member 15, to bring the lips 40 of the tongue 38 into engagement with the inclined surfaces 45 of the ramps 45. This rotation is in an anticlockwise direction as seen in FIG. 3 and will cause the lip 40 of the respective tongue 38 to ride up the inclined surface 46 of the cooperating ramp 45, so as to draw the annular portions 35 and 43 respectively towards each other in an axial direction as viewed in FIG. 3. The appropriate dimensioning of the inner and outer ring members 15 and 16, relative to the dimensions of the sealing ring portion 17 of the sleeve member 10 and the thickness of the sheet 18, enables the relative rotation between the inner and outer ring members to compress the sealing ring 17 into pressure sealing engagement with the surface of the sheet 18.

The angle of the inclined face 46 of the ramp 45 is chosen so that the relative rotation between the inner and outer ring members 15 and 16 can be effected manually to derive the necessary sealing pressure between the sealing ring and the plate 18. Conveniently the angle of the ramp is in the order of 5° to 10°, which will permit manual operation during assembly, and also preclude any likelihood of the ring members rotating in the reverse direction to release the compression pressure, under the forces which will exist in the clamping arrangement once it has been assembled.

The outer ring member 16 is provided with a pair of axially projecting lugs 50 to assist in rotation of the member 16 during assembly as previously described. After assembly the lugs 50 may be bent to overlay the ramps 45 rearward of the lips 40 and so prevent rotation of in the direction to release the sealing pressure. One of the lugs is shown in this position in FIG. 3.

The flexible non-resilient sheet 18 to which the flashing device is fitted may conveniently be of lead, aluminum, copper or other material which will not be subject to corrosion under normal atmospheric conditions, and may include galvanised or other suitably coated steel sheet. The sheet is normally cut to a rectangular shape of sufficient dimensions so that when assembled to a tile or slate roof, the top edge portion of the sheet may be inserted between the overlapping edges of the tiles above the location of the flashing device, whilst the lower edge may be deformed to follow the contour of and overlap the junction of thr row of tiles below the flashing device. The manner in which the sheet 18 is fitted to a tile or slate roof is a conventional procedure, and the advantage of the present invention is the provision of the flashing device which provides the effective seal between the sheet 18 and the pipe 19 extending through the roof.

Figure 4:
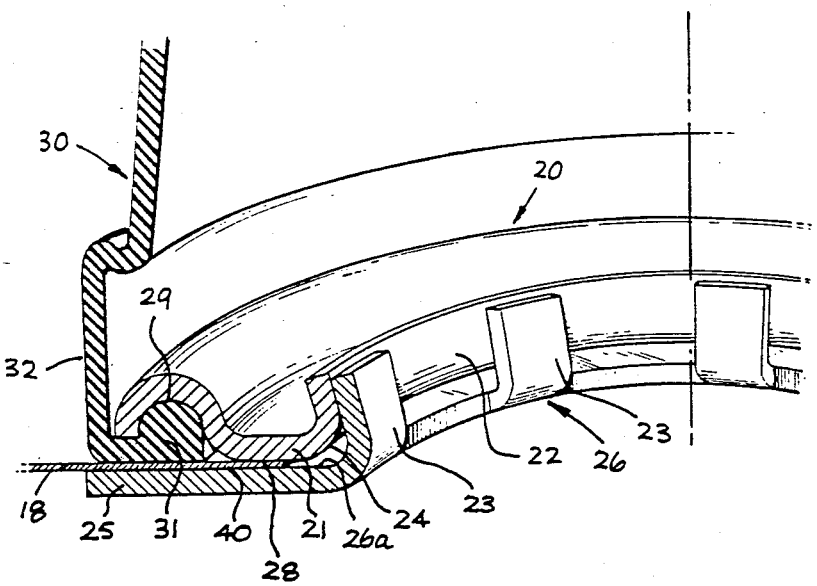
FIG. 4 is a perspective sectional view of part of an alternative construction of the attachment ring assembly for the flashing device.

FIG. 4 of the drawings shows portion of an alternative construction of the ring assembly 14 whereby it is assembled in a snap action to compress portion of the sleeve member into a sealing engagement with the sheet.

Referring now to FIG. 4 the inner ring member 20 comprising a flat annular portion 21 with a skirt portion 22 projecting generally axially from the inner periphery of the annular portion. The skirt portion is inclined upwardly and outwardly with respect to the axis of the annular portion. The junction of the skirt portion 22 and flat annular portion 21 presents a downwardly directed convex or arcuate surface 24 that blends smoothly with each said portion.

The outer ring member 26 is in the form of flat annulus with a plurality of upwardly and outwardly directed fingers 23 about the inner peripheral edge thereof. The fingers 23 are dimensioned to enter the central opening defined by the skirt portion 22 of the inner ring member 20, and to engage the skirt portion 22 in a snap action to hold the inner and outer ring members in assembly. The convex surface 24 of the inner ring member assists in promoting the resilient deflection of the fingers 23 to establish the snap action engagement of the fingers with the skirt portion 22.

The downwardly directed annular bead grooves 29 provided in the first ring member 20, outwardly of the annular portion 21, is of generally semi-circular cross-section and located upwardly of the lower surface 28 of the annular portion 21. The sleeve member 30 is generally of the same construction as shown in FIG. 2 and has at the lower end a bead 31 which extends inwardly and upwardly with respect ot the apron portion 32 of the sleeve member. The bead 31 is continuous about the lower end of the sleeve member and is received in the bead groove 29 of the inner ring member. Preferably the diameter of the apron 32 at the lower end is selected so that it must be stretched to receive the inner ring member 20 so they will normally remain in assembly.

The bead 31 and bead groove 29 are dimensioned so that, when the inner ring member 20, with the sleeve member assembled thereto, is assembled to the sheet 18, and the outer ring member 26 is assembled to the inner ring member, the bead 31 will be compressed between the sheet and the inner ring member to form a seal therebetween. Preferably when so assembled the sheet 18 is also clamped between the annular portion 21 of the inner ring member and the flat annular portion **26*a*** of the outer ring member.

As the principle use for the flashing device is sealing about pipes that project through the roof of a building, and as such roofs are usually inclined to the axis of the pipe, the axis of the apron 12,32 is inclined to the axis of the tubular portion 11 of the sleeve member 10,30.

The pitch or inclination of a building roof may vary with the design of the building and the roofing material used. Normally the angle of the roof is between 15° to 35° to the horizontal. Accordingly the angle between the surface of the roof and the axes of a vertical pipe passing therethrough is 75° to 55°.

Provided the diameter of the central opening in the inner and outer ring members is sufficient, relative to the diameter of the pipe passing therethrough, a range of roof inclinations can be accommodated by the same flashing device.

The sleeve member 10 is formed from a flexible resilient material, such as rubber or a thermoplastic material, selected so that it will retain its resilient properties in the environment to which it is intended to be subjected in use. As the major application for the flashing device will result in the sleeve member being positioned on vents or conduits extending the roof or external wall of a building, it will be exposed to a range of climatic conditions, including strong sunlight, a resilient material, particularly suitable for use in such conditions are ethylene propylene diene monomers and ethylene propylene terpolymer.

The fold portion 13 and apron 12 provide a substantial degree of flexibility between the attachment assembly 14 and the tubular member 10 to accommodate misalignment between the various components, and if required a greater degree of flexibility can be obtained by using a multiple fold or pleat construction.

As the flashing device is intended to cover a range of pipe or conduit sizes, the opening 9 at the upper end of the tubular section is of a size to receive in sealing engagement the smallest size conduit intended to be used. The upper end portion 8 of the tubular member is provided with concentric grooves 7 which correspond to the size of aperture required to accommodate three further sizes of conduits. A workman may enlarge the size of the opening 9 by cutting along either one of the grooves to suit the particular size conduit. Larger sizes of conduit may be accommodated by cutting around the periphery of the tubular portion 10 at appropriate locations.

The claims defining the invention are as follows:

We claim:

1. A device for flashing about a pipe or conduit passing through a roof or wall, a first member having an aperture therethrough for a pipe or conduit to pass through and a continuous first abutment surface extending about said aperture, a second member having an aperture therethrough for the pipe or conduit to pass through and a continuous second abutment surface extending about said aperture, said apertures and abutment surfaces being arranged so that when the first and second members are assembled to a pipe or conduit that extends through the respective apertures, the first and second abutment surfaces are in an opposing face to face substantially parallel relation substantially transverse to the axis of the pipe or conduit, means to secure the first and second members together in said assembled relation with a sheet of flexible material therebetween and through which the pipe or conduit also extends and a sleeve of flexible resilient material adapted at one end for attachment to the first member so that a pipe or conduit extending through the first and second members also extends through the sleeve, the other end of the sleeve being adapted to sealably engage the external surface of the pipe or conduit extending therethrough, said one end of the sleeve including a portion located in use to be compressed between the sheet and one of the members when the first and second members are secured together in said assembled relation.

2. A device as claimed in claim 1 wherein said one end of the sleeve is adapted to be attached to the first member so that in use said portion of the sleeve is located between the abutment surfaces of the first and second members.

3. A device as claimed in claim 2 wherein the portion of the sleeve is an annular bead seated in an annular bead groove formed in the first member substantially co-axially with the aperture in the first member.

4. A device as claimed in claim 2 wherein the perimetal edge of the first member is received in a recess in the internal surface of sleeve.

5. A device as claimed in claim 3 wherein the perimetal edge of the first member is received in a recess in the bead portion of the sleeve.

6. A device as claimed in claim 1, wherein the first and second member carry interlockable elements adpated to co-operate where the first and second members are assembled with said portion of the sleeve compressed between one of the members and sheet to maintain the members in assembly and said portion of the sleeve compressed.

7. A device as claimed in claim 6 wherein the interlockable elements co-operate in a snap-action to secure the first and second members in assembly.

8. A device as claimed in claim 6 wherein each of the members is of annular form with the inner periphery of each having a shirt extending generally in the axial direction, each of said skirts being inclined outwardly and adapted so that when the members are in the assembled position the two skirts interlock in a snap action to occupy a nesting relation.

9. A device as claimed in claim 8 wherein the skirt on one member is substantially continuous in the circumferential direction and the skirt on the other member is a series of circumferentially spaced segments.

10. A device as claimed in claim 1 wherein the first member has a continuous annular portion adapted for location within said one end of the sleeve with a sealing ring integral with the sleeve underlying the annular portion, and a continuous skirt at the inner periphery of the annular portion to in use project axially inward of the sleeve and incline radially outward with respect to the axis of the first member, and wherein the second member has an annular portion adapted in use to underlie the annular portion of the first member with the sealing ring therebetween, a plurality of fingers spaced along the inner periphery of the annular portion of the second member and integral therewith, said fingers being adapted to engage in a snap action the inner peripheral surface of the skirt of the first member when assembled thereto, and when so engaged to hold the sheet in sealing engagement against the sealing ring.

11. A device as claimed in claim 1 wherein the means to secure the first and second members together comprise a plurality of ramps formed on the first members spaced about the inner periphery thereof, and a plurality of complement tongues on the second member, said ramps and tongues being arranged to co-operatively engaged by initially inserting the tongues through the central aperture of the first member and thereafter effecting relative angular movement between the two members to move the tongues upwardly along the ramps.

12. A device as claimed in claim 11 wherein the second member is in use located substantially within said one end of the sleeve with said portion of sleeve underlying the second member.

13. A device as claimed in claim 10, wherein an outer peripheral portion of the first member is frictionally gripped by the sleeve to normally hold the sleeve and first member in assembly.

* * * * *